US007031027B2

(12) United States Patent
Beisswenger et al.

(10) Patent No.: US 7,031,027 B2
(45) Date of Patent: Apr. 18, 2006

(54) METHOD AND APPARATUS FOR SETTING THE IDLE DISTANCE OF AN ENGRAVING STYLUS FROM THE CYLINDER SURFACE OF A ROTOGRAVURE PRINTING CYLINDER

(75) Inventors: Siegfried Beisswenger, Preetz (DE); Michael Biewer, Kiel (DE)

(73) Assignee: Hell Gravure Systems GmbH, Kiel (DE)

( * ) Notice: Subject to any disclaimer, the term of this patent is extended or adjusted under 35 U.S.C. 154(b) by 1003 days.

(21) Appl. No.: 10/025,015

(22) Filed: Dec. 19, 2001

(65) Prior Publication Data

US 2002/0089697 A1 Jul. 11, 2002

(30) Foreign Application Priority Data

Dec. 22, 2000 (DE) ..... 100 64 813

(51) Int. Cl.
*B41C 1/02* (2006.01)
*B41C 1/045* (2006.01)
*B41C 1/18* (2006.01)

(52) U.S. Cl. ..... 358/3.29; 358/3.32

(58) Field of Classification Search ..... 358/3.29, 358/3.32, 3.3, 3.31; 700/160, 186, 192, 193
See application file for complete search history.

(56) References Cited

U.S. PATENT DOCUMENTS 5,454,306 A * 10/1995 Fraser et al. ..... 358/3.32
5,652,659 A * 7/1997 Bornhorst et al. ..... 358/3.29
5,719,683 A * 2/1998 Yoshida ..... 358/3.29
5,737,090 A * 4/1998 Christopher et al. ..... 358/3.29
6,099,177 A * 8/2000 Ito ..... 101/3.1

* cited by examiner

*Primary Examiner*—Scott A. Rogers
(74) *Attorney, Agent, or Firm*—Schiff Hardin LLP

(57) ABSTRACT

An idle distance of an engraving stylus for engraving a rotogravure printing cylinder is set from the cylinder surface of the rotogravure printing cylinder by use of a sliding element that is provided for the guidance of the engraving stylus connected to the sliding element along the cylinder surface during engraving. The setting of the idle distance is undertaken relative to a reference surface that is indicative of the cylinder surface.

17 Claims, 7 Drawing Sheets

METHOD AND APPARATUS FOR SETTING THE IDLE DISTANCE OF AN ENGRAVING STYLUS FROM THE CYLINDER SURFACE OF A ROTOGRAVURE PRINTING CYLINDER

BACKGROUND OF THE INVENTION

The invention is directed to a method for setting the idle distance of an engraving stylus for engraving a rotogravure printing cylinder from the cylinder surface of the rotogravure printing cylinder upon involvement of a sliding foot that is provided for the guidance of the engraving stylus connected to the sliding foot along the cylinder surface during engraving.

The invention is also directed to an adjustment mechanism, preferably for implementation of the method.

For rotogravure, a printing form is usually engraved into the cylinder surface of a rotogravure printing cylinder with an engraving stylus or with a plurality of engraving styli. The tip of the engraving stylus thereby normally comprises diamond.

For the engraving, the engraving stylus is driven in vibrating fashion with a prescribed frequency and amplitude. The image information to be engraved is superimposed as a signal on this basic vibration, so that the engraving stylus, when vibrating, enters into the cylinder surface with a different depth or does not enter thereinto according to the image information. Simultaneously, the rotogravure printing cylinder is driven in rotating fashion, and the engraving stylus is moved along the cylinder surface in the axial direction either continuously or in steps in order to achieve a continuation of the engraving image, which usually comprises a matrix of cups. During its relative motion over the cylinder surface, an engraving head comprising the engraving stylus is supported on the cylinder surface via a sliding foot, likewise preferably comprising diamond. For varying the spacing of the engraving head from the cylinder surface, the sliding foot can usually be retracted or extended farther transverse relative to the axis of the rotogravure form cylinder with a spindle, whereby "transverse" does not necessarily mean perpendicular to the axis and the sliding foot also need not necessarily lie in a radial path relative to the axis but, for example, can also be secantially aligned.

When the vibratory drive is turned off, the engraving stylus is situated at a slight clearance from the cylinder surface in its idle position, whereby this idle distance is prescribed by the setting of the extended length of the sliding foot. This idle distance, of course, must agree very precisely so that the image information is engraved into the cylinder surface as intended. The position of the engraving tip corresponds to the zero-axis crossing of the amplitude of the basic vibration of the engraving stylus without image information or given the image information, to not engrave at the corresponding location of the cylinder surface. The idle distance amounts, for example, to 3 through 5 micrometers, preferably 4 micrometers, and should be set to a precision of at least 10%.

During engraving, however, the engraving stylus wears over time or can even be damaged. The engraving styli must therefore be replaced by new ones relatively often. After such a replacement, however, the idle distance must be reset because, although the engraving tips or the cutting geometry of the engraving styli coincide, the engraving styli do not otherwise have structural lengths that coincide precisely enough. Just like the setting of the idle distance, thus the change of the engraving styli must be undertaken more frequently in engraving operations, namely more or less at the same time for a plurality of engraving machines since the rotogravure printing cylinders for the various colors of a color printing are usually engraved roughly simultaneously.

Up to now, one proceeded for setting the idle distance such that the new engraving stylus is roughly positioned and the spindle of the sliding foot is then moved slowly inward given a rotating rotogravure printing cylinder until the engraving stylus just barely lies against the cylinder surface and leaves a very slight scratch thereon, this lie there against being recognizable therefrom. With the assistance of a precision thread, the spindle is in turn moved outward by precisely the desired idle distance, as a result whereof this idle distance of the engraving stylus is directly produced.

This, however, is an inadequate and unsatisfactory procedure. Great care must be exercised in the described setting. A specific test cylinder is employed, this having to be chucked into the engraving machine for the setting and in turn removed therefrom later. Despite its high capital costs, the engraving machine cannot be used for engraving for the entirety of the adjustment work. The test cylinder does not rotate under machined drive, but is carefully manually turned a little over and over again by a person. The creation of the scratch is subjectively checked, and the return turning of the spindle of the sliding foot occurs with an angle prescribed by the operator. The procedure can therefore only be imprecisely objectively reproduced. Each operator obtains a somewhat different result.

SUMMARY OF THE INVENTION

An object of the invention is to improve the setting of the idle distance of the engraving stylus in rotogravure engraving.

According to the invention, the setting of the idle distance is undertaken with reference to a reference surface that replaces or represents the cylinder surface.

Exemplary embodiments to which the scope of the invention is not limited are shown in the drawings.

DESCRIPTION OF THE PREFERRED EMBODIMENTS

Figure 1:
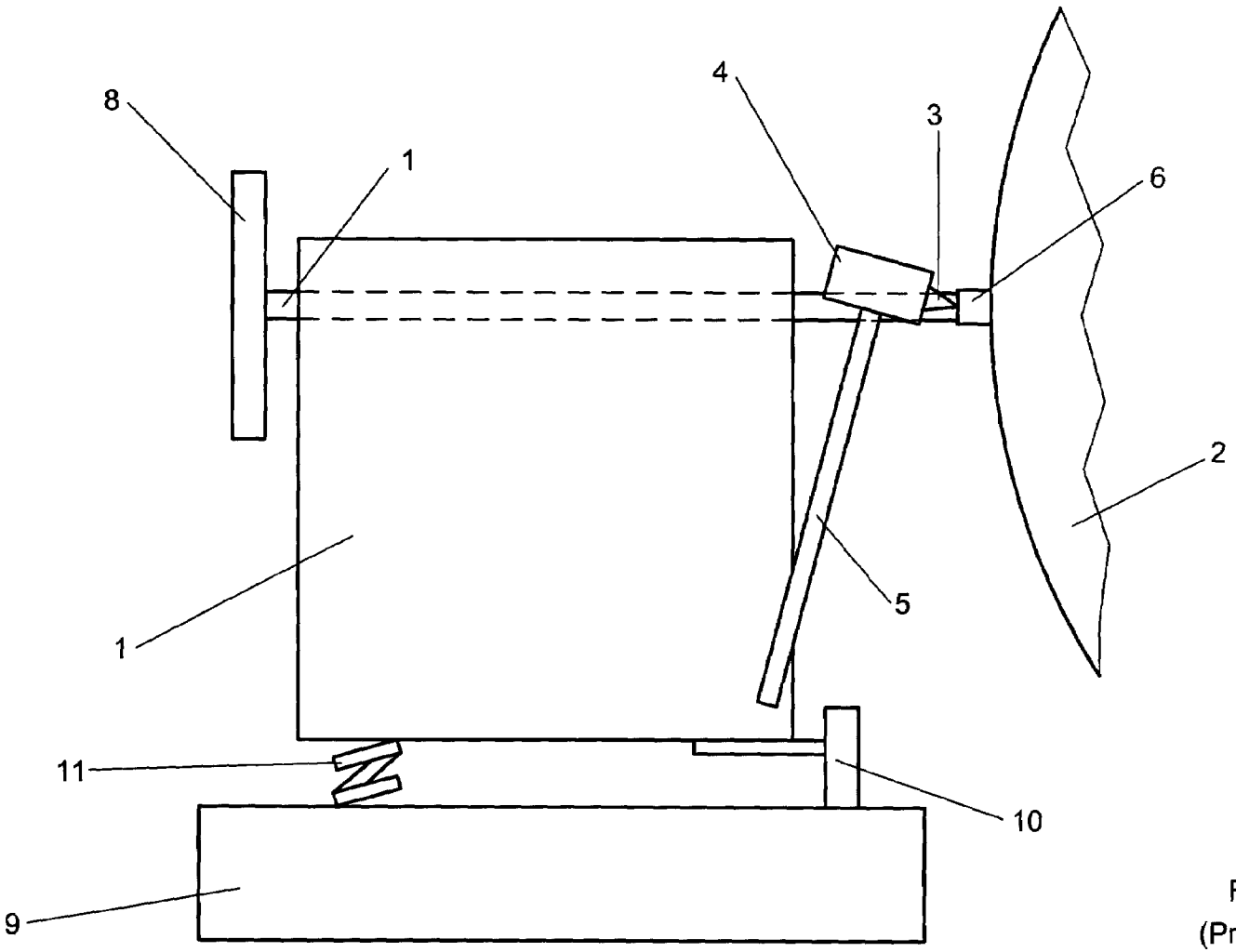
Fig. 1 (Prior Art)
FIG. 1 is an engraving head placed against a rotogravure printing cylinder, shown in a side view in an engraving machine that is not shown in detail.

For the purposes of promoting an understanding of the principles of the invention, reference will now be made to the preferred embodiments illustrated in the drawings and specific language will be used to describe the same. It will nevertheless be understood that no limitation of the scope of the invention is thereby intended, such alterations and further modifications in the illustrated device and/or method, and such further applications of the principles of the invention as illustrated therein being contemplated as would normally occur now or in the future to one skilled in the art to which the invention relates.

With the system and method disclosed, a rotogravure printing cylinder to be engraved can advantageously remain in the engraving machine, and the engraving machine can also be used during the setting event, particularly when it is provided according to a development of the method that the engraving head or the sliding foot with the engraving stylus that is connected to it and at which the setting is to be undertaken is moved out of its working position during the setting, preferably being removed from the engraving machine, and is replaced by an engraving head that has already been adjusted. The method appears especially economical in that only one setting device need be provided for an entire set or stock of engraving machines.

Since, ultimately the engraving stylus fundamentally works in a tangential plane of the cylinder surface, a plane, preferably a planar surface of a plate, can be employed as a reference surface, as provided in a development of the method, for easier setting and manipulation as well as installation of a device.

There are fundamentally different, conceivable possibilities of monitoring and measuring the setting of the idle distance. In particular, the monitoring and measurement, potentially even the setting event itself, should be implemented as objectively and reproducibly as possible, potentially even automated.

One possibility is comprised in a mechanical or electromechanical monitoring. For that purpose, for example, the engraving stylus can be moved against a resilient region of the reference surface by moving the spindle of the sliding foot in and the resiliency thereof can be registered and measured with a sensor. This can then be taken with the desired precision as a reference for the adjustment, whereby the necessary movements are preferably undertaken motorized and not manually by a person in order to achieve a reproducible precision and avoid jerky movements that could destroy the engraving stylus. Care can thereby also be exercised to see that the setting is always undertaken with a specific moving direction of the engraving stylus in order to avoid hystereses of the system or spindle running imprecisions in the measurement. This, of course, also applies to monitoring modes other than mechanical ones.

Another possibility of monitoring and measuring is comprised in an optical procedure.

The idle distance between the engraving tip and the reference surface that has been set and the variation thereof can thereby by made directly visible and observed. For example, a measurement or scale microscope can be employed therefor. One can look directly through this, or the generated image can be rendered visible in an even easier way by video camera on a picture screen, whereby an additionally improved and more precise scale can be selected by means of a projection factor generated in the transmission system. Moreover, an additionally more exact and more objective setting is possible when the reference surface is mirrored or reflective since the (double) idle distance of the engraving tip relative to its mirror image can then be set, whereby a zero point to be exactly defined can then be eliminated due to the symmetry that is thereby obtained, the zero point being potentially not optically recognizable precisely enough and capable of being absolutely defined.

In a side view, FIG. 1 schematically shows the traditional working position of an engraving head 1 in a side view of an engraving machine not shown in greater detail. For that purpose, the engraving head 1 is placed against the cylinder surface of a rotogravure printing cylinder 2. An engraving stylus 3 with a stylus holder 4 is pivotably arranged at the engraving head 1 and can be driven in vibrating fashion around its stylus axis 5, which is inclined by 15° in the illustrated exemplary embodiment. Guided via a sliding foot 6, the engraving head 1 is supported on the cylinder surface. The sliding foot 6 can be retracted and extended with a spindle 7 and an adjustment wheel 8, as a result whereof the idle distance of the tip of the engraving stylus 3 from the cylinder surface is set.

The engraving head 1 is resiliently seated on a support 9 (not shown in detail), and is pivotably seated via leaf springs 10 that serve as a revolute joint and which is supported on coil springs 11.

FIG. 2 again shows the region from FIG. 1 in a plan view. As in the following Figures as well, identical component parts are referenced with the same reference characters as in FIG. 1.

Figure 2:
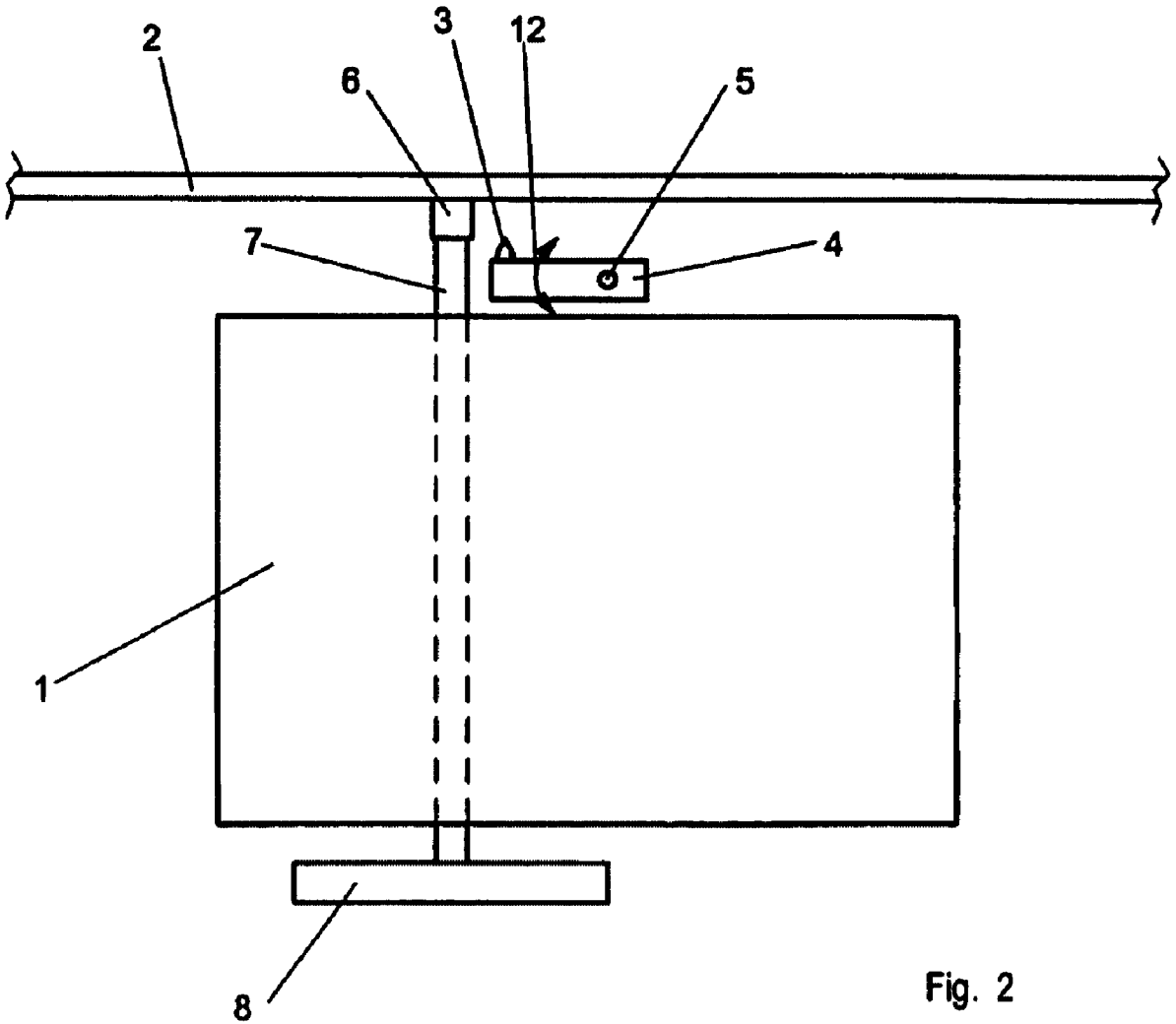
Fig. 2 (PRIOR ART)
FIG. 2 illustrates the region illustrated in FIG. 1 shown in a plan view.

In particular, FIG. 2 shows a plan view of the arrangement of the stylus holder 4 at the stylus axis 5 that can be pivoted in the direction of the double arrow 12.

Figure 3:
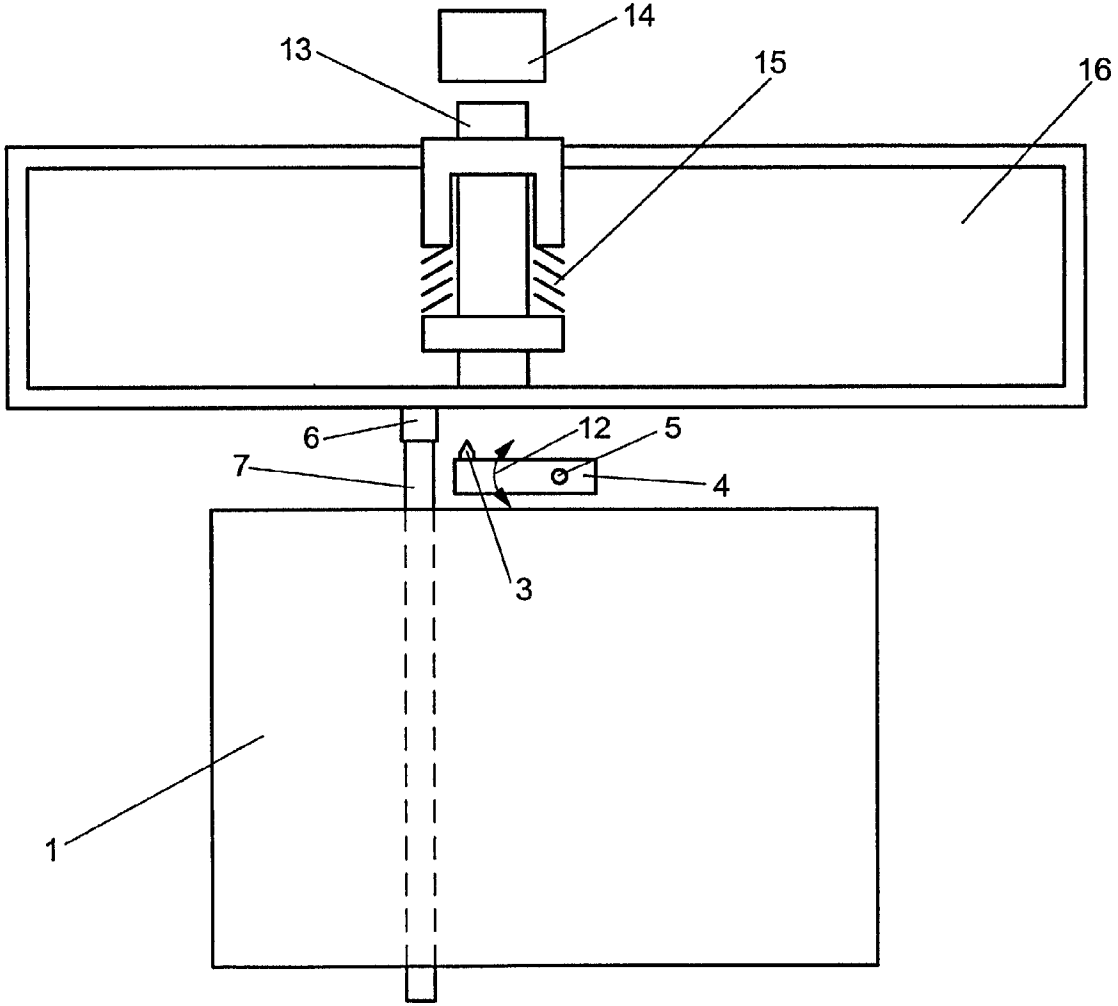
FIG. 3 is a first, electromechanical exemplary embodiment of a setting mechanism shown in plan view.

FIG. 3 shows a plan view of a first exemplary embodiment of an inventive setting mechanism that works electromechanically.

For setting or for reference definition of the idle position of the engraving stylus 3 here, the engraving stylus 3 is moved against a detent pin 13 by moving the spindle 7 of the sliding foot 1 in with a motor (not shown) instead of the adjustment wheels 8, the motion path thereof being registered and measured with an electronic distance sensor 14. After the reference for the engraving stylus 3 acquired in this way, this is precisely brought into it a desired position relative to the sliding foot 1 in that the spindle 7 is in turn moved outward in defined fashion. The measuring pin 13 is seated in softly resilient fashion with a spring 15 in order to avoid damage to the engraving stylus 3. For this same reason, a motor is employed instead of the hand wheel 8 in order to be able to implement the movement of the engraving stylus with greater control. For the precise reference measurement to the sliding foot 6, the measuring pin 13, in its non-deflected position, has its end face terminating precisely with a surface of a ground detent plate 16 for the sliding foot 6.

Figure 4:
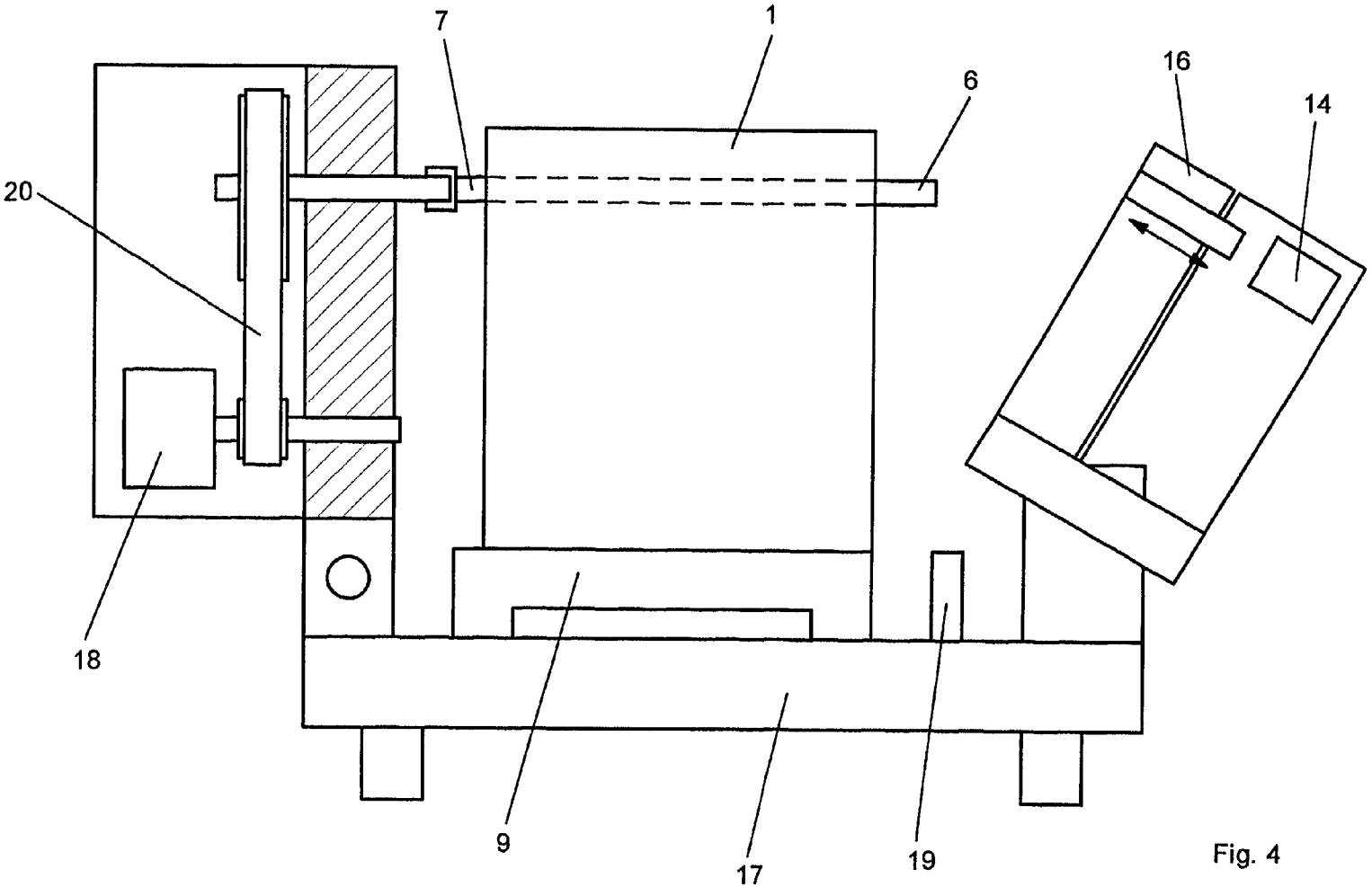
FIG. 4 illustrates the exemplary embodiment according to FIG. 3 in a side view for a stylus replacement.

FIG. 4 shows the exemplary embodiment of FIG. 3 in a side view.

The detent plate 16 with sensor 14 is folded away for a problem-free stylus replacement. In this position, the newly introduced engraving stylus can also be set in height with the assistance of a camera (not shown). For that purpose, the engraving head 1 is placed on a carrier 17 in a corresponding measuring device outside an engraving machine, the detent plate 16 and the sensor 14 being hinged thereto and pivotable up to a stop 19.

The motor 18 that drives the spindle 7 via a V-belt can also be seen in FIG. 4.

Figure 5:
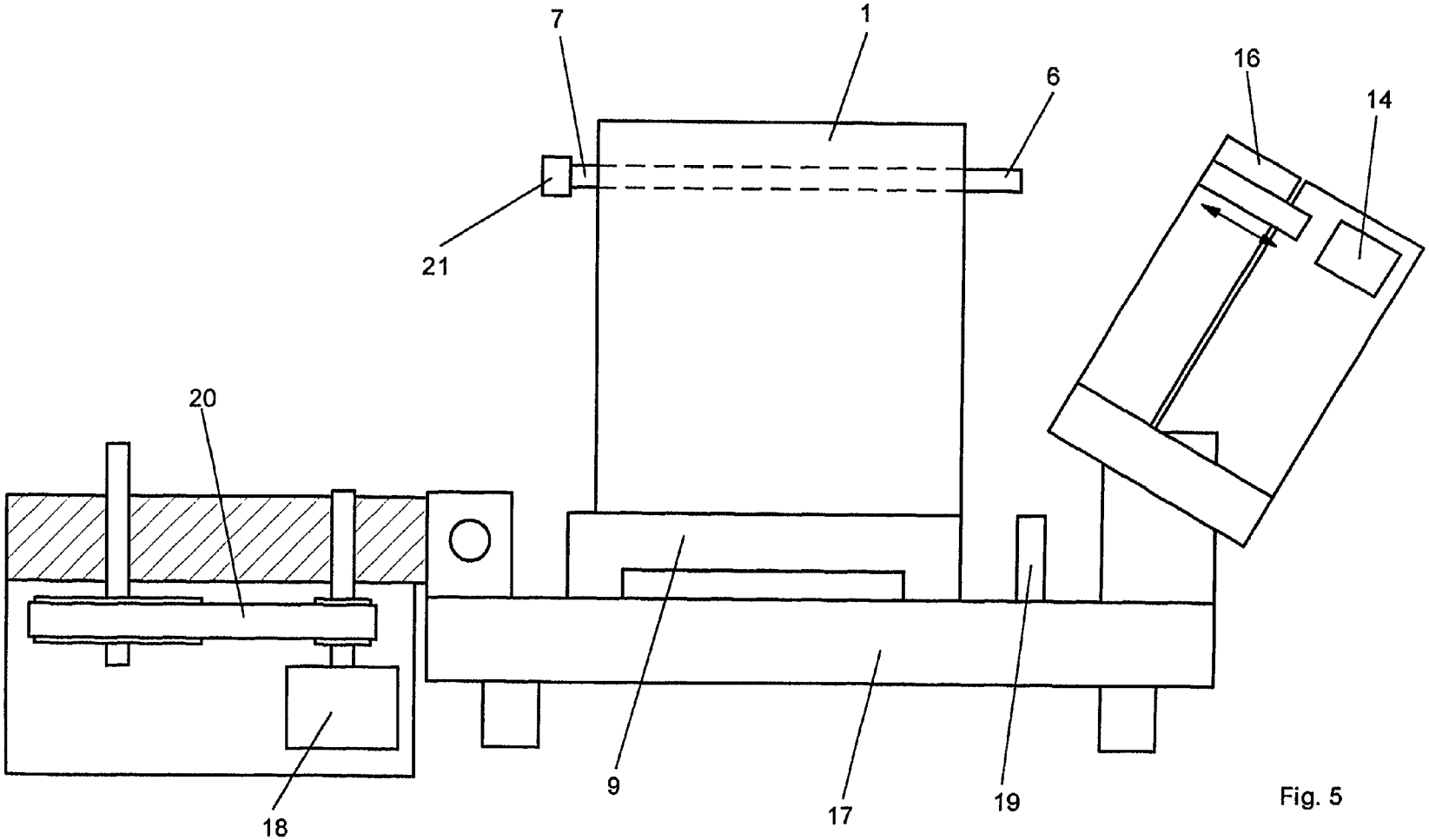
FIG. 5 illustrates the exemplary embodiment according to FIG. 4 for engraving head replacement.

FIG. 5 shows the mechanism according to FIG. 4 again in a side view with the drive unit (motor 18 and V-belt 20) for the sliding foot 6 or the spindle 7 thereof likewise folded away in order to enable a replacement or removal and introduction of the entire engraving head 1 into and out of the measuring device. The spindle 7 comprises a peg 21 for coupling the spindle 7 to the drive unit.

Figure 6:
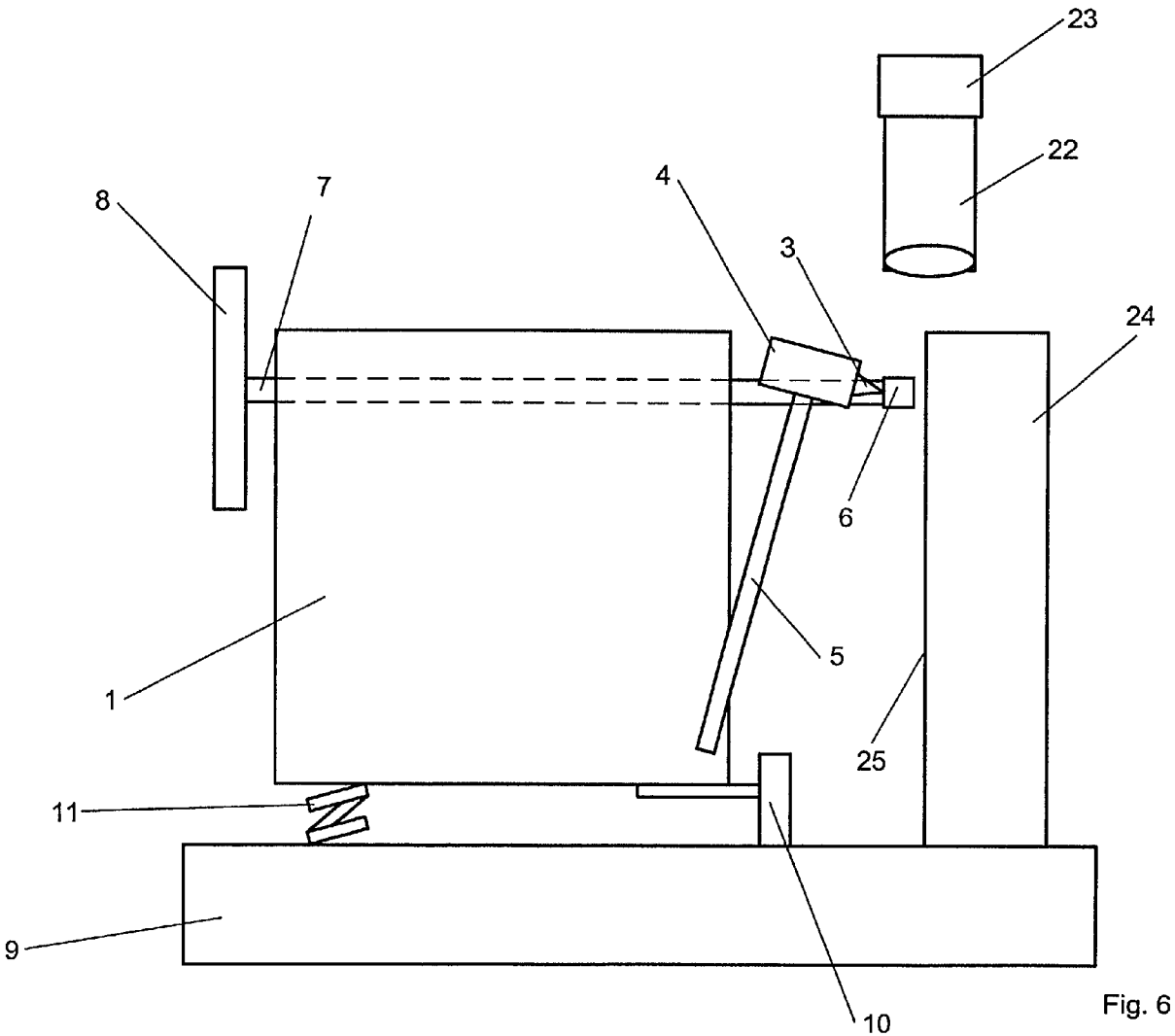
FIG. 6 illustrates a second, optical exemplary embodiment of a setting mechanism, shown in a side view.

FIG. 6 shows a side view of a second exemplary embodiment of an adjustment mechanism that works optically. This time, the position of the stylus tip of the engraving stylus 3 is directly observed and measured with a camera 23 equipped with a microscope 22, the camera 23 being arranged over the engraving stylus 3. For the measurement, the microscope 22 comprises an ocular micrometer. The distance from the surface (reference surface 25) of a specific reference plate 24 is measured.

Figure 7A:
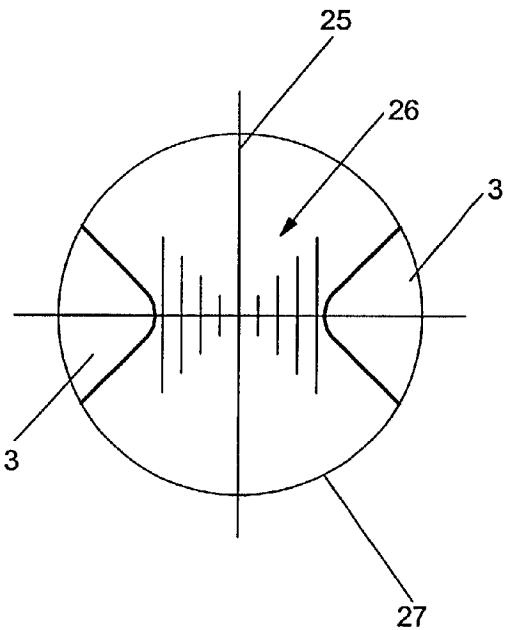
FIG. 7*a* shows the detail VIIa from FIG. 7 in an excerpted view.
Figure 7:
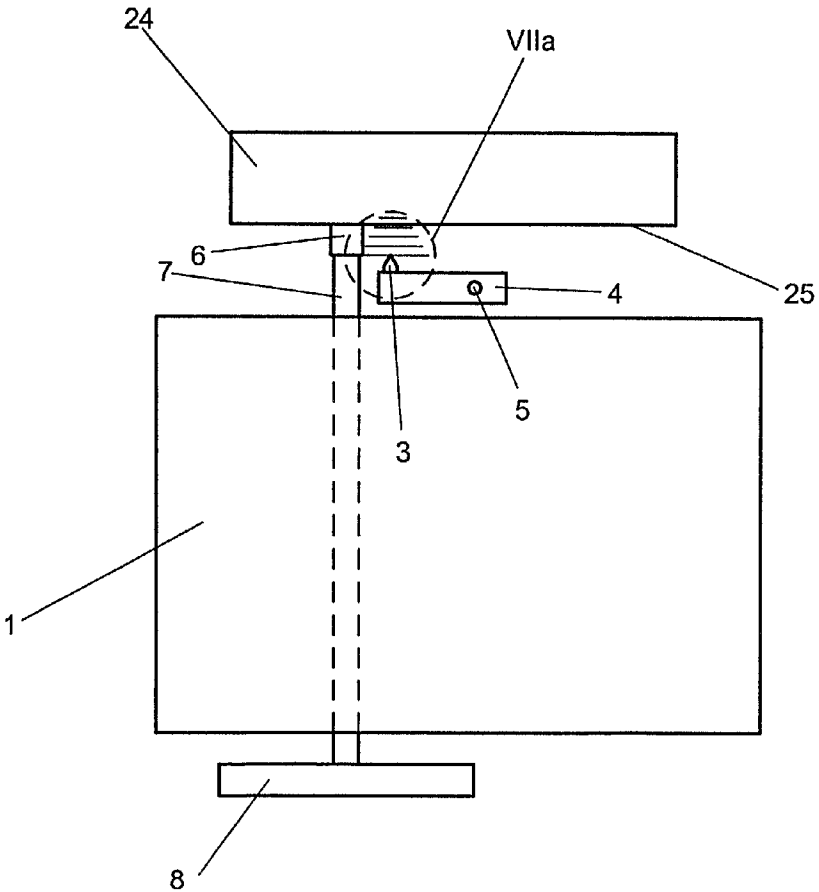
FIG. 7 illustrates the exemplary embodiment according to FIG. 6 in plan view.

FIG. 7 shows the apparatus according to FIG. 6 in plan view. The observation region of the camera 23 (which itself is not shown in FIGS. 7 and 7*a*) or of the microscope, is marked therein as a detail with a broken line and is referenced VIIa. This detail is emphasized in FIG. 7*a*.

The reference surface 25 of the reference plate 24 is reflective. It is therefore not only the stylus tip of the engraving stylus 3 itself that can be recognized with the camera, but also its mirror image 3' in the reference surface. As a result thereof, the stylus tip can be set symmetrically relative to its own mirror image, which can be measured or calibrated with a scale (ocular micrometer 26) in the ocular viewing field 27 of the microscope 22.

While preferred embodiments have been illustrated and described in detail in the drawings and foregoing description, the same is to be considered as illustrative and not restrictive in character, it being understood that only two of the preferred embodiments have been shown and described, that all changes and modifications that come within the spirit of the invention are desired to be protected, and that the invention may be provided in additional embodiments now or in the future.

We claim as our invention:

1. A method for setting an idle distance of an engraving stylus for engraving a rotogravure printing cylinder from a cylinder surface of the rotogravure printing cylinder, comprising the steps of:

providing a sliding foot for guidance of the engraving stylus connected to the sliding foot along the cylinder surface; and setting the idle distance with respect to a reference surface that replaces or represents the cylinder surface.

2. The method according to claim 1 wherein the sliding foot together with the engraving stylus connected to it is brought from its working position in an engraving machine before the setting and is brought back into the working positions after the setting.

3. The method according to claim 1 wherein a planar surface is employed as the reference surface.

4. The method according to claim 1 wherein the setting is mechanically or electromechanically monitored and measured.

5. The method according to claim 4 wherein in the setting, the engraving stylus is displaced or moved against a movable detent in defined fashion, the movement thereof being qualitatively monitored and measured.

6. The method according to claim 5 wherein the engraving stylus is moved by machine and controlled.

7. The method according to claim 1 wherein the setting is optically monitored and measured.

8. The method according to claim 7 wherein a measuring or scale microscope is employed.

9. An apparatus for setting an idle distance of an engraving stylus for engraving a rotogravure printing cylinder from a cylinder surface of the rotogravure printing cylinder, comprising:

a sliding foot for guidance of the engraving stylus connected to the sliding foot along the cylinder surface; and said apparatus comprising a reference surface replacing the cylinder surface.

10. The apparatus according to claim 9 wherein the reference surface is designed planar.

11. The apparatus according to claim 9 wherein said apparatus comprises a measurement and monitoring device.

12. The apparatus according to claim 11 wherein the measurement and monitoring device works substantially electromechanically.

13. The apparatus according to claim 12 wherein the measurement and monitoring device comprises a motion sensor.

14. The apparatus according to claim 11 wherein the measurement and monitoring device works substantially optically.

15. The apparatus according to claim 14 wherein the reference surface is mirrored or reflective, and the measurement and monitoring device simultaneously acquires a tip of the engraving stylus and its mirror image.

16. A method for setting an idle distance of an engraving stylus for engraving a rotogravure printing cylinder from a cylinder surface of the rotogravure printing cylinder, comprising the steps of:

providing a sliding element for guidance of the engraving stylus connected to the sliding element along the cylinder surface; and setting the idle distance with respect to a reference surface that is indicative of the cylinder surface.

17. An apparatus for setting an idle distance of an engraving stylus for engraving a rotogravure printing cylinder from a cylinder surface of the rotogravure printing cylinder, comprising:

a sliding element for guidance of the engraving stylus connected to the sliding element along the cylinder surface; and said apparatus comprising a reference surface replacing the cylinder surface.

* * * * *